US008907189B2

(12) United States Patent
Bernacki et al.

(10) Patent No.: US 8,907,189 B2
(45) Date of Patent: Dec. 9, 2014

(54) STABILIZED MUSICAL HORN INSTRUMENT

(71) Applicants: Robert Henry Bernacki, Bloomington, IN (US); Jeffrey Lee Goodman, Tyler, TX (US)

(72) Inventors: Robert Henry Bernacki, Bloomington, IN (US); Jeffrey Lee Goodman, Tyler, TX (US)

( * ) Notice: Subject to any disclaimer, the term of this patent is extended or adjusted under 35 U.S.C. 154(b) by 145 days.

(21) Appl. No.: 13/831,756

(22) Filed: Mar. 15, 2013

(65) Prior Publication Data

US 2014/0260892 A1 Sep. 18, 2014

(51) Int. Cl.
*G10D 9/02* (2006.01)
*G10D 7/10* (2006.01)

(52) U.S. Cl.
CPC ..... *G10D 7/10* (2013.01)
USPC ..... 84/380 R

(58) Field of Classification Search
USPC ..... 84/380 R, 387 R, 387 A
See application file for complete search history.

(56) References Cited

U.S. PATENT DOCUMENTS 6,504,087 B2 * 1/2003 Shulman ..... 84/387 A

* cited by examiner

*Primary Examiner* — Kimberly Lockett

(57) ABSTRACT

A stabilized musical horn instrument is revealed, comprising a traditional wind instrument of the type employing a horn outlet, a stabilizer mechanism comprising an axially rotated friction mechanism for locking an assembly of a pair of telescoping tubes in a deployed position and a linearly operated magnetic mechanism to retain the tubes in a retracted position; and further comprising a surface engagement assembly coupled to the distal tube of the telescoping tube assembly.

19 Claims, 6 Drawing Sheets

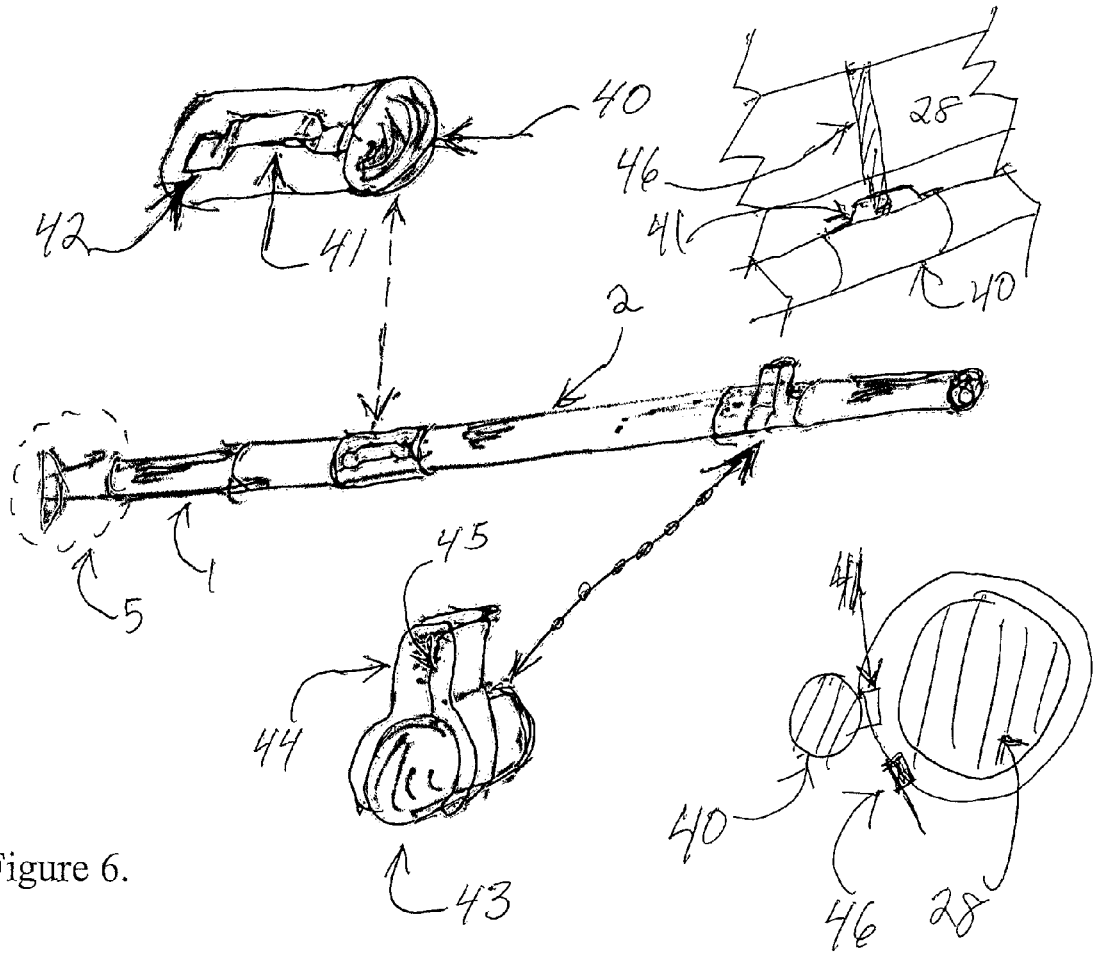
Figure 6.
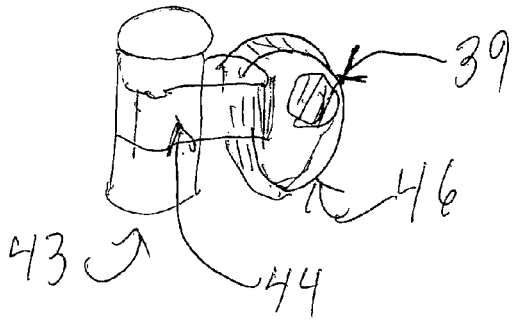

STABILIZED MUSICAL HORN INSTRUMENT

RELATED APPLICATION DATA

The first Inventor has a related application submitted for which an application number has not yet been received, titled: RAPID DEPLOY MANUALLY OPERATED EXTENSIBLE STRUT.

FEDERALLY SPONSORED RESEARCH

Not Applicable

REFERENCE APPENDIX

Not Applicable

BACKGROUND OF THE INVENTION

The field of the present Invention is related to manually operated wind instruments of a type of construction employing a horn or bell at the terminus of the resonant tube and of a size and shape that require placing or resting on a floor or stage when in not in use during interludes between playing. More particularly, those instruments that are placed with the open face of the bell resting on the floor or on a surface are not designed for stability and are prone to damage, particularly in educational settings with young musicians. Solutions presented to this problem in the past have included self-supporting rack type stands on which the instrument was placed, however, no convenient, low-profile, low weight, rapid-deploy, instrument-mounted solution has been offered to date.

BRIEF SUMMARY OF THE INVENTION

In the present Invention, an instrument-mounted stabilizer is revealed that permits rapid-deployment and retraction with a few brief hand motions while minimizing both the physical dimensions and minimizing force required for the locking and unlocking of the stabilizer in a retracted position. These results are obtained through the application of a combination of a twist-lock friction mechanism employed to lock the stabilizer in a deployed or extended position, with a magnetic catch mechanism employed to retain the stabilizer in a shortened or retracted position.

The contemplated embodiment of the present Invention is comprised of one or more pairs of telescoping tubes attached to the instrument by braces, mechanical links to fasten parallel tubes together, a technique generally employed by manufactures of musical instruments. In the basic configuration, the stabilizer is comprised of an inner and an outer tube, wherein the inner is fitted with a rapidly expanding cam ring and cam-crank twist-lock mechanism for locking the two tubes together. A key feature of this choice of locking mechanism is that it provides excellent linear force capacity while requiring only a sixty degree rotation. Additionally, in some applications, for instance in certain designs of instruments, tubing configurations are compact, affording only limited opportunities to mount additional features such as a stabilizer. In a second embodiment of the Invention, the outer tube is fitted with an internal magnetic catch mechanism, whereby the inner tube is retained within the outer tube in the retracted position by magnetic coupling. This second key feature of the addition of the magnetic catch eliminates the requirement that an additional length of tubing be exposed to permit sufficient surface for grasping and twisting in the retracted position as is required for a twist-lock mechanism. A third feature of this Invention is a surface engagement assembly comprised of a flexible ball-joint and a contact plate, providing alignment and distribution of force between the instrument and the surface on which it rests.

The stabilizer would normally be in the retracted position while the musician is playing the instrument. When taking a break, the musician would deploy the stabilizer with a slight tug on the foot, disengaging the magnetic catch and drawing the inner tube linearly outward, extending the stabilizer to a desired length to contact a supporting surface, positioned in nearly infinite increments, subsequently grasping the inner tube, and rotating or twisting about a sixth of a turn relative to the outer tube, thereby engaging the twist-lock mechanism causing it to frictionally lock the inner tube relative to the outer tube. The contactor plate ball joint typically accommodates an angle of the stabilizer, relative to and generally perpendicular, to the contacted surface of seventy to ninety degrees, the angle formed by the intersection of a plane of the musical instrument horn bell flare with a longitudinal axis of the stabilizer. When the occasion arrives to retract and stow the stabilizer, the musician grasps the inner tube, rotates it approximately sixty degrees in an opposite direction from that of the locking rotation, disengaging the twist-lock mechanism, and then linearly pushes the inner tube back into the outer tube whereby the magnetic catch pole pieces engage again, retaining the inner tube in the retracted position.

Additional objects, features, and advantages of the present invention will become apparent to those skilled in the art upon consideration of the following illustration of the contemplated embodiment presented in the detailed description, operation, and accompanying drawings.

BRIEF DESCRIPTION OF THE DRAWINGS

The detailed description of a contemplated device embodiment of the present invention makes reference to the accompanying figures in which

FIG. 6 depicts coupling sleeves and their positions on the stabilizer, and

DETAILED DESCRIPTION OF THE INVENTION

Referring now more particularly to the figures, a following description of components and their relationships shall serve to illuminate various particulars of an illustrative embodiment of the disclosures and teachings of the present invention. Throughout the following description are several references to specific components which serve to clarify various aspects of the invention. It will be understood that these specific component references are not limitations and that the teachings and disclosures of the present invention may be practiced with alternative components. In other instances, structures and methods well known to those skilled in the art have been omitted in order to avoid unnecessary complexity which would tend to obscure the teachings and disclosures of the present invention.

Figure 1:
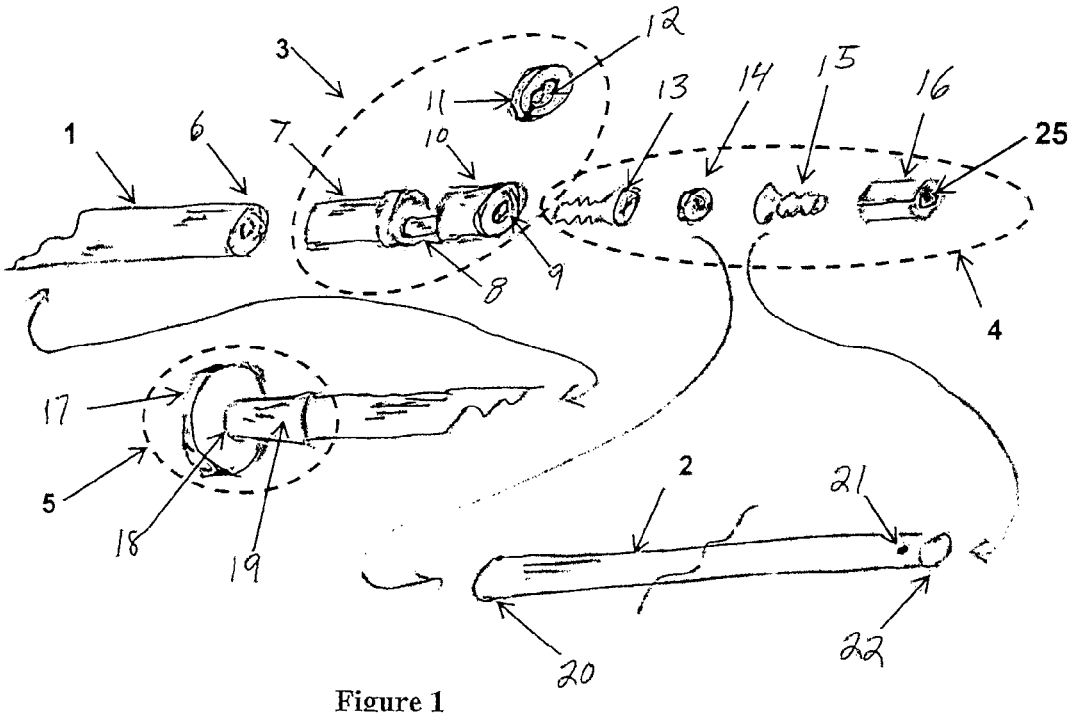
FIG. 1 depicts an exploded perspective view showing all parts of the example stabilizer locking mechanisms and FIG. 2 depicts a partial cross-section view revealing locking mechanisms assembled.
Figure 2:
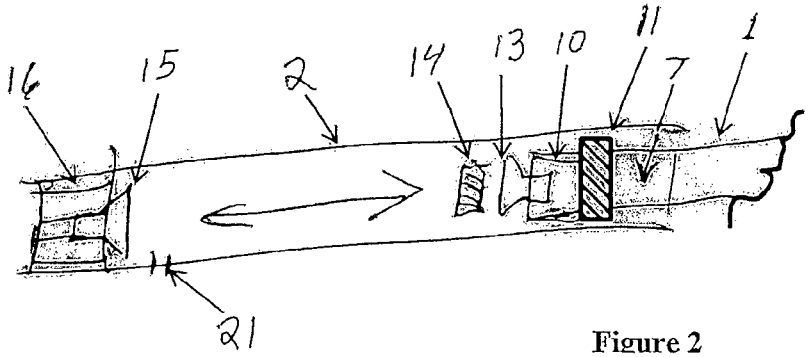

Referring now to FIG. 1 and FIG. 2 of an example embodiment of a the twist-lock mechanism, of the horn stabilizer, an assembly, shown in aggregate as FIG. 2, of a pair of concentric telescopically arranged cylindrical tubes, comprising, an outer tube, referred to by a numeral 2, having a diameter of approximately one half to approximately one inch or as required for accommodating a manual grasp and having a receptive end 20 and a catch end 22. Said outer tube further having at said receptive end 20 and partially incorporated within it, an inner tube 1, said inner tube 1 having a section of a locking end 6 within said outer tube 2. Said inner tube may be of a solid filled type in a basic configuration. Said locking end 6 is axially coupled to a frictional twist-lock mechanism 3 comprising a cam shaft 7, coupled to a cam crank 8, that in turn is coupled to a cam head 10 having a head bore 9, wherein, said cam crank 8 center is offset from said cam shaft 7 center by approximately 10% of said cam shaft 7 diameter and is approximately 45% of the diameter of cam shaft 7. Mounted on said cam crank 8 is a cam ring 11 having a figure eight shape cam bore 12 relieved by a cam ring slot 23, said cam bore 12 having a diameter of approximately 125% of said cam crank 8. A preferred type of material for said cam ring 11 is polypropylene or alternatively, polyethylene. Said cam ring 11 should have a diameter of approximately a few thousandths of an inch less than the inner diameter of said outer tube. Said cam shaft 7 and said cam crank 8 may be from a range of materials as used by those skilled in the art. A preferred type of tube employed is of a "thin-wall" variety possessing a thickness of approximately 3% of the diameter of the tube and having a precision telescoping clearance of approximately one half of a percent of the tube diameter. In this embodiment, said outer tube 2 is of a non-magnetic or non-ferrous material such as aluminum, copper alloys, brass, resin bonded fiber, and the like.

Said cam head 10 is coupled to a magnetic catch mechanism 4 comprised of a traveling pole 13, a floating magnet 14, a fixed pole 15, a pole mount 16 and a mount bore 25, wherein said traveling pole 13 is fastened in said head bore 9 in said cam head 10 and said pole mount 16 is fastened internally within said outer tube 2 at the catch end 22. Said fixed pole 15 is fastened in said mount bore 25 of said pole mount 16, facing said traveling pole 13, and is magnetically coupled to said floating magnet 14. Additionally, said outer tube 2 is depicted having an air vent hole 21 adjacent to said fixed pole 15. One advantage of utilizing a magnet in a floating configuration is that of avoiding adhesives, threaded fasteners or press fits and the like, thereby affording simplicity and greater durability over the life of the device. Said floating magnet 14 may be fashioned in a variety of shapes, including, but not limited to, cylindrical and cubic.

One possible embodiment of the invention, as depicted here, additionally has a foot or engagement assembly 5 coupled to a distal end 24 of said inner tube 1, said engagement assembly 5 being comprised of a shaft 19 having a ball joint 18 coupled to a plate 17. Said ball joint 18 should have a range of motion of approximately +/−30 degrees.

Figure 3:
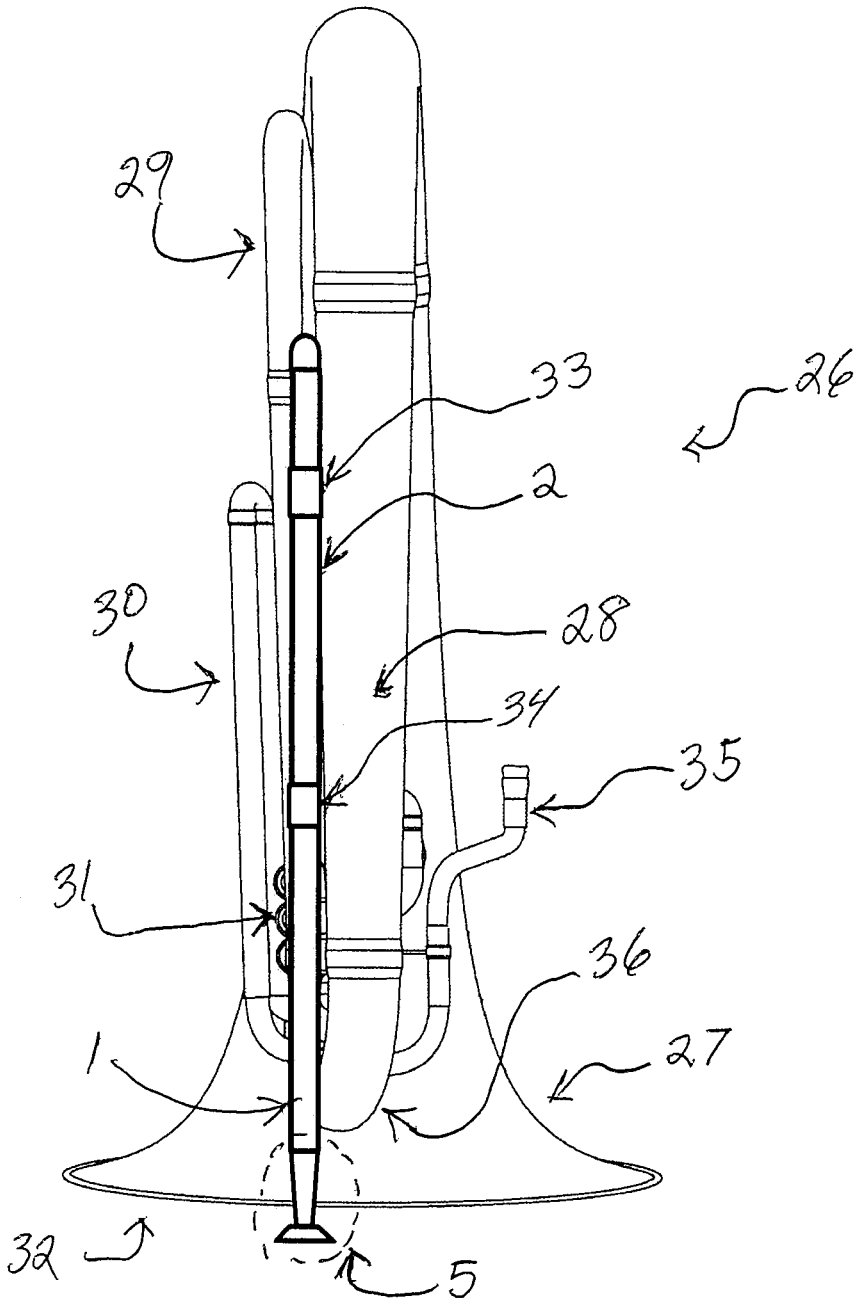
FIG. 3 depicts a vertical view of a typical installation on a large brass horn such a tuba from the first branch side, with FIG. 4 showing a view of the same instrument facing the bell.
Figure 4:
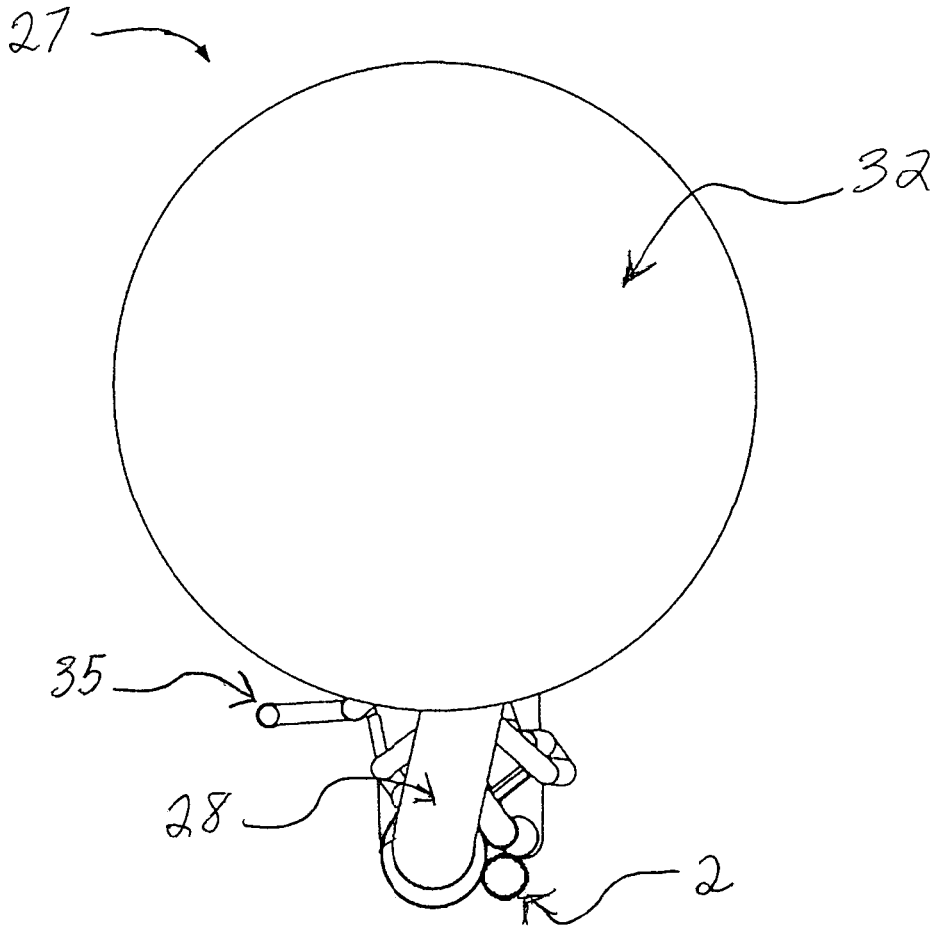

FIG. 3 depicts a vertical view of a typical installation on a large brass horn 26 such a tuba in a perspective view of a large branch tube 28, also known as the "first branch", said large branch coupled to a bell flare horn 27, with an opening bore 32 and coupled to a second branch bow 36. Said stabilizer inner tube 1 is coupled to said engagement assembly 5 and said outer tube 2. A lower cylinder tube 34 and an upper cylinder tube 33 are depicted coupled to the outer tube 2. Included for positional reference are shown a third branch 29 and a tuning slide tube 30 to the left above edges of three finger buttons 31, and to the right, a mouth pipe 35 is depicted. FIG. 4 showing a view of the same instrument with a view facing said opening bore 32 of said bell flare horn 27. Said large branch tube 28 is depicted adjacent to the outer tube 2 while said mouth pipe 35 is shown for positional reference.

Figure 5:
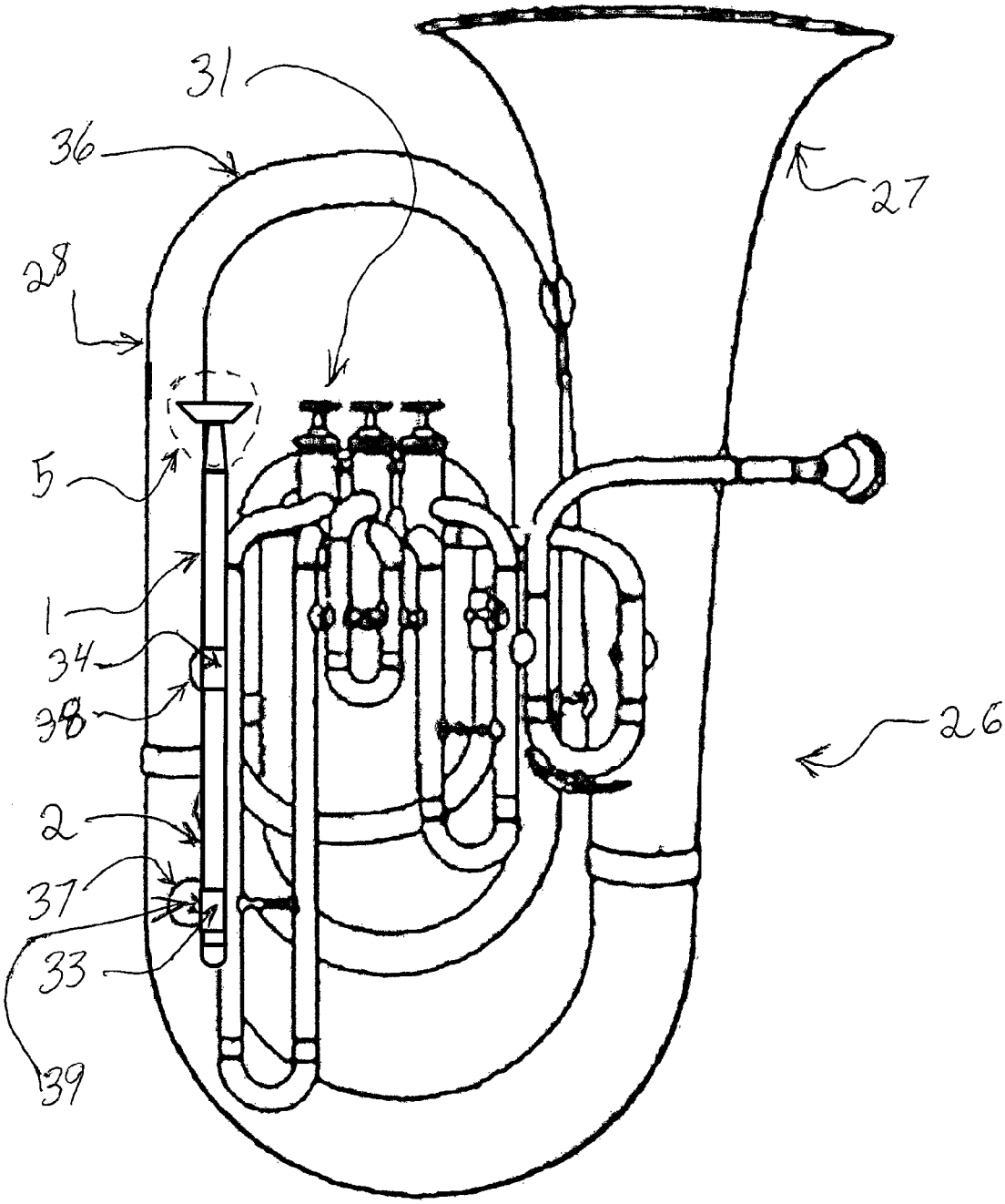
FIG. 5 depicts another horn style with a side view facing the valves.
Figure 7:
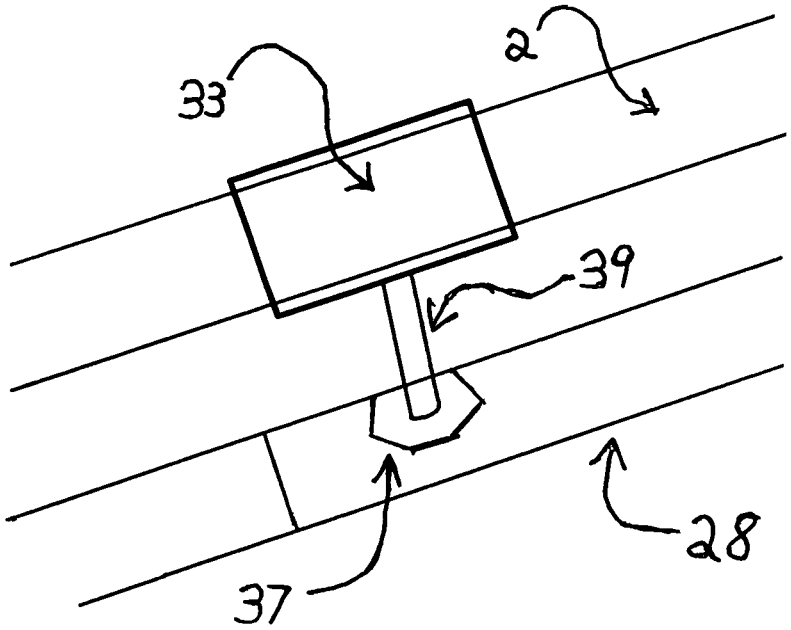
FIG. 7 is a close-up of a brace coupling two tubes.

FIG. 5 depicts another horn style with a side view facing said three finger buttons 31, with corresponding elements as above with an addition of a brace assembly 38 coupled to the large branch tube 28. A brace plate 37, also known as a flange, is coupled to a brace connector 39, also known as a brace rod, in turn, coupled to upper cylinder tube 33. FIG. 6 depicts an alternative means for coupling the stabilizer outer tube 2 to said large branch tube 28 and/or said a third branch 29, for example. A connector sleeve 40 having an u-bracket anchor 41 bonded at bonding location 42 is depicted by reference line coupled to outer tube 2. A second embodiment of a brace connector sleeve 43 having a bracket brace 44, with bore hole 45, is also depicted by reference line coupled to outer tube 2. These connector sleeves are configured to be utilized for field retro-fitting of an instrument with stabilization, the sleeves being received by a technician, in a slidable state and then located for fitting to an instrument and subsequently bonded to the outer tube 2 and clamped to a large branch 28, for example, with clamping means 46. Said clamping means 46 passed through u-bracket anchor 41 of said connector sleeve 40 and circumferentially enclosing said large branch 28. Said brace connector sleeve 43 having a bracket brace 44, with clamping means 46 passing through bore hole 45 and circumferentially enclosing said brace connector 39. FIG. 7 depicts a close-up of said brace assembly 38 wherein, coupled to the large branch tube 28 is said brace plate 37, in turn, coupled to said brace connector 39, in turn, coupled to upper cylinder tube 33. These coupling means depicted in FIG. 7 are typically a bonded type.

Those skilled in the art will recognize a variety of means for fastening or coupling the components, such as braces, cylinders and plates described above, including, but not limited to, chemical adhesive bonding; thermal bonding, including the addition of solders or rods of metal or plastic material; and mechanical methods including threaded fasteners, rivets, swaging and staking. Thermal bonding techniques, particularly utilizing thermoplastics, are the preferred means of bonding in the field retrofit configuration. Said clamping means 46 can be selected from a variety of types and materials, however, preferred types would include materials of plastic that would not mark the surface of the tubing. Ratchet types of clamps, such as zip-ties, and hook and loop types would be preferred type of mechanisms for fastening and tightening the clamps. Metal clamps or clamping means such as metal bands could be bonded to connectors and branches, E.G.: soldered, by a technician as a field modification, however, the cost might be a factor, in which case, various threaded fasteners might be used if lined with a softer material. The selection of clamps could be made by a technician skilled in the art.

A description of the operation of the locking mechanisms is now presented for illustrative purposes. Referring now to the embodiment of the Invention, as depicted in FIGS. 1 and 2 and assuming it would be in an initial retracted state before use, a linear force is applied to inner tube 1 along the main axis of the inner tube 1 relative to the outer tube 2, releasing the magnetic catch mechanism 4, disengagement of the magnetically coupled floating magnet 14 being from either the traveling pole 13 or the fixed pole 15, and subsequently moving the inner tube 1 away from the catch end 22, thereby lengthening the stabilizer. Said inner tube 1 may then be linearly positioned in nearly infinite increments along the length of the outer tube 2. At the desired position, the twist-lock mechanism 3 is engaged by the rotation of the inner tube 1 in either a clockwise or counter-clockwise direction through an approximately sixty degree rotation, wherein the cam shaft 7 rotates the cam crank 8, said rotation subsequently converted by the combined motion of the cam crank 8 and cam ring 11 assembly into a radial force applied to the outer tube 2 by the cam ring 11, thereby creating a frictional lock between the two tubes. The tubes specified herein are of the precision type, resulting in an assembly that requires an air vent hole 21 in the outer tube 2 adjacent to the fixed pole 15 to permit the escape of air due to the displacement of air in the outer tube when the inner tube is moved in relation to it and thus avoiding a build-up of air pressure in the outer tube 2 that would resist such movement.

Those skilled in the art will identify many instruments and models that require a device based upon the present invention. Although one possible embodiment has been described to illustrate the teachings and disclosures of the present invention, it is not limited to the specific foregoing illustrative embodiment or applications and that various and several modifications in design, arrangement, and use may be made within the scope and spirit of the invention as expressed in the following claims:

What is claimed is:

1. A stabilized musical horn instrument comprising:
a musical instrument flared horn;
at least one branch of tubing coupled to said musical instrument flared horn;
a stabilizer comprised of;
an assembly of at least two concentric telescopically mated tubes comprising;
an outer tube coupled to at least one said branch of tubing, and having a first end and a second end;
at least one inner tube, having an end section partially incorporated within and in contact with said outer tube at said first end;
a twist-lock mechanism;
wherein said twist-lock mechanism, in contact with said outer tube and proximal to said first end and said twist-lock mechanism in contact with said inner tube and proximal to said end section, retains the inner tube to the outer tube.

2. The stabilized musical horn instrument of claim 1, further comprising:
a magnetic catch mechanism comprising;
a first part coupled to said outer tube at said second end, and;
a second part coupled to said inner tube at said end section.

3. The stabilized musical horn instrument of claim 1, further comprising:
a means for engaging a surface comprising;
a distal end of said inner tube assembly;
a shaft coupled to said distal end of said first tube assembly;
a ball joint coupled to said shaft;
a plate coupled to said ball joint;
wherein, said means for engaging a surface accommodates an angle formed by the intersection of a plane of said musical instrument flared horn with a longitudinal axis of said inner tube.

4. The stabilized musical horn instrument of claim 1, said inner tube and said outer tube being a non-ferrous alloy precision thin-wall tubing type.

5. A stabilized musical horn instrument, comprising:
a musical instrument flared horn;
at least one large tubing branch coupled to said musical instrument flared horn;
a stabilizer comprising;
an outer tube having a receptive end and a catch end;
at least one means for coupling said outer tube to at least one said large tubing branch;
an inner tube being telescopically slidable within said outer tube at said receptive end;
a means for locking said inner tube to said outer tube, coupled to said inner tube and enclosed by said outer tube;
a magnetic catch mechanism having a first part coupled to said outer tube at said catch end;
a second part of said magnetic catch mechanism coupled to said means for locking;
wherein sliding said inner tube towards said catch end magnetically engages said first part with said second part of said magnetic catch mechanism.

6. The stabilized musical horn instrument of claim 5, said means for locking comprising:
a cam shaft;
a cam crank coupled to said cam shaft;
a cam ring mounted on said cam crank;
wherein, a rotation of said inner tube in either a clockwise or counter-clockwise direction through less than a single rotation, rotates said cam shaft, in turn rotating said cam crank, said rotation subsequently converted by a combined motion of said cam crank and said cam ring into a radial force applied to said outer tube, thereby creating a frictional lock between said tubes.

7. The stabilized musical horn instrument of claim 5, said inner tube being solid filled.

8. The stabilized musical horn instrument of claim 5, said inner tube and said outer tube being approximately one half inch to approximately one inch in diameter.

9. The stabilized musical horn instrument of claim 5, said inner tube and said outer tube being of a copper alloy precision thin-wall tubing type.

10. The stabilized musical horn instrument of claim 5, further comprising:
a means for engaging a surface comprising;
a distal end of said inner tube assembly;
a shaft coupled to said distal end of said first tube assembly;
a ball joint coupled to said shaft;
a plate coupled to said ball joint;
wherein, said means for engaging a surface accommodates an angle formed by the intersection of a plane of said musical instrument flared horn with a longitudinal axis of said inner tube.

11. The stabilized musical horn instrument of claim 5, said outer tube further comprising:
A vent hole bored into said outer tube proximal to said magnetic catch mechanism first part.

12. The stabilized musical horn instrument of claim 5, having at least one said means for coupling comprising:
a cylinder tube being approximately one inch in length, fitted concentrically, with a precision fit of approximately a few thousandths of an inch and bonded to said outer tube;
a connector brace, approximately perpendicular and bonded to said cylinder tube, and;
said connector brace being coupled to said large tubing branch.

13. The stabilized musical horn instrument of claim 12, said connector brace comprising:

a means for clamping approximately circular members, said means for clamping having a circumference from approximately one to approximately two inches;

a perpendicular member of approximately of one to three inches in length bonded to said cylinder tube;

a distal end of said perpendicular member;

at least one bore hole in said perpendicular member proximal to said distal end;

a large tubing branch brace coupled to said large tubing branch;

wherein, said perpendicular member is in contact with said large tubing branch brace, said bore hole receives said means for clamping through said bore hole, clamping said perpendicular member to said large tubing branch brace.

14. The stabilized musical horn instrument of claim 5, having at least one said means for coupling comprising:

a cylinder sleeve being approximately one inch in length, fitted concentrically, with a precision fit of approximately a few thousandths of an inch and bonded to said outer tube;

a means for clamping approximately circular members, said means for clamping having a circumference from approximately one to approximately four inches;

a u-bracket anchor, of approximately a length of said cylinder sleeve and bonded to said cylinder sleeve;

wherein, said cylinder sleeve is bonded to said outer tube, said u-bracket anchor receives said means for clamping, clamping said u-bracket anchor to said large tubing branch brace.

15. A stabilized musical horn instrument, comprising:

a musical instrument flared horn;

at least one branch of tubing coupled to said musical instrument flared horn;

a stabilizer comprised of;

a first tube assembly, having a locking end, comprising;

a twist-lock mechanism, coupled to said locking end, comprising;

a cam shaft;

a cam crank coupled to said cam shaft;

a cam ring mounted on said cam crank;

a first magnetic pole coupled to said twist-lock mechanism;

a second tube assembly, having a receptive end and a catch end, comprising;

a magnetic catch, coupled to said catch end, comprising;

a second magnetic pole;

a magnet magnetically coupled to said second magnetic pole;

at least one stabilizer brace coupling said second tube assembly to at least one said branch of tubing;

wherein said first tube assembly is telescopically slidable within said second tube assembly, said locking end enclosed within said second tube assembly at said receptive end, said twist-lock mechanism operable by rotating said first tube assembly relative to said second tube assembly, and, said magnetic catch operable by linearly moving said first tube assembly linearly within said second tube assembly, in a first direction to separate said magnet from said first magnetic pole or said second magnetic pole, or in a second direction to engage said magnet simultaneously with both said first magnetic pole and said second magnetic pole.

16. The stabilized musical horn instrument of claim 15, said first tube assembly and said second tube assembly being approximately one half inch to approximately one inch in diameter.

17. The stabilized musical horn instrument of claim 15, said first tube assembly and said second tube assembly being of a copper alloy precision thin-wall tubing type.

18. The stabilized musical horn instrument of claim 15, further comprising:

a means for engaging a surface comprising;

a distal end of said inner tube assembly;

a shaft coupled to said distal end of said first tube assembly;

a ball joint coupled to said shaft;

a plate coupled to said ball joint;

wherein, said means for engaging a surface accommodates an angle formed by the intersection of a plane of said musical instrument flared horn with a longitudinal axis of said first tube assembly.

19. The stabilized musical horn instrument of claim 15, said second tube assembly further comprising a vent hole bored into said outer tube proximal to said second magnetic pole.

* * * * *